United States Patent [19]

Mayer

[11] Patent Number: 4,656,841

[45] Date of Patent: Apr. 14, 1987

[54] RESILIENT IMPACT-TYPE LATCH NEEDLE FOR KNITTING MACHINE

[75] Inventor: Harald Mayer, Albstadt, Fed. Rep. of Germany

[73] Assignee: Theodor Groz & Söhne & Ernst Beckert Nadelfabriken Commandit Gesellschaft, Albstadt-Ebingen, Fed. Rep. of Germany

[21] Appl. No.: 817,157

[22] Filed: Jan. 7, 1986

Related U.S. Application Data

[63] Continuation of Ser. No. 633,594, Jul. 23, 1984, abandoned.

[30] Foreign Application Priority Data

Aug. 27, 1983 [DE] Fed. Rep. of Germany ..... 3331030

[51] Int. Cl.[4] ..... D04B 35/04

[52] U.S. Cl. ..... 66/121; 66/173

[58] Field of Search ..... 66/121, 122, 123, 124; 163/3, 5

[56] References Cited

U.S. PATENT DOCUMENTS

| | | | |
|---|---|---|---|
| 1,764,342 | 6/1930 | Parlini | 66/121 |
| 3,331,218 | 7/1967 | Barth | 66/124 X |
| 4,099,391 | 7/1978 | Fukuhara | 66/121 |
| 4,294,086 | 10/1981 | Mayer | 66/121 |

FOREIGN PATENT DOCUMENTS

| | | | |
|---|---|---|---|
| 1026913 | 3/1958 | Fed. Rep. of Germany | 66/121 |
| 1069812 | 5/1960 | Fed. Rep. of Germany . | |
| 2714607 | 10/1978 | Fed. Rep. of Germany . | |
| 44-27176 | 11/1969 | Japan . | |
| 55-46790 | 11/1980 | Japan . | |
| 1591613 | 6/1981 | United Kingdom | 66/121 |
| 2074614 | 11/1981 | United Kingdom | 66/123 |

*Primary Examiner*—Wm. Carter Reynolds

*Attorney, Agent, or Firm*—Frishauf, Holtz, Goodman & Woodward

[57] ABSTRACT

A latch needle for knitting machines has a needle latch supported such that it is pivotable in an undamped manner, and the seating surface on the latch spine is formed in wedge shape with converging surfaces. Seating surfaces adapted to the seating surface on the latch spine are provided on the upper edges of the side portions of the longitudinal slot of the needle, and this longitudinal slot is provided, in the region below the latch pivot, with an aperture or slit extending to the lower edge of the needle shank. In order to intercept the needle latch in a damped, substantially bounce-free manner when the latch, in its open or rearward position, meets the seating surfaces on the upper edges of the side portions of the longitudinal needle slot, the side portions of the shank beneath the seating surface for the latch are formed with longitudinal slots, or with through-slits to provide a region of increased elastic deformability in the two shank side portions defining the longitudinal slot and/or in the shank below the seating surfaces.

12 Claims, 8 Drawing Figures

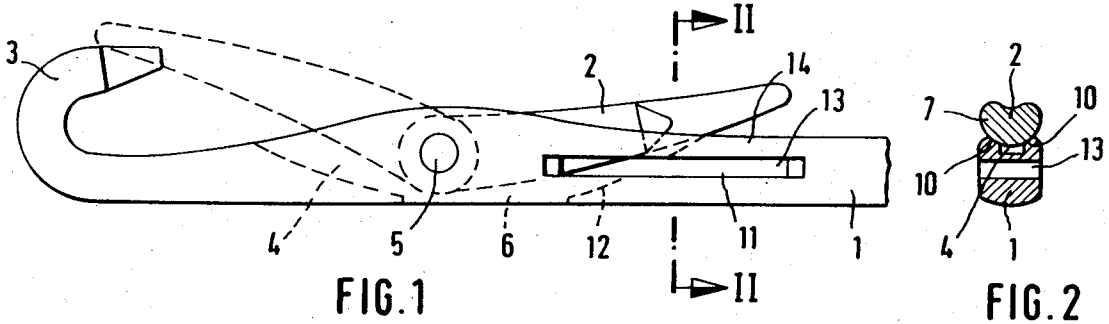
FIG. 1
FIG. 2
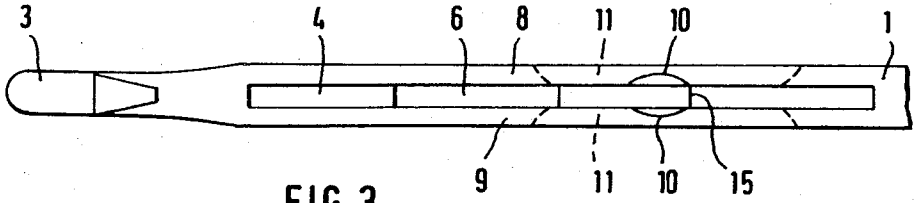
FIG. 3

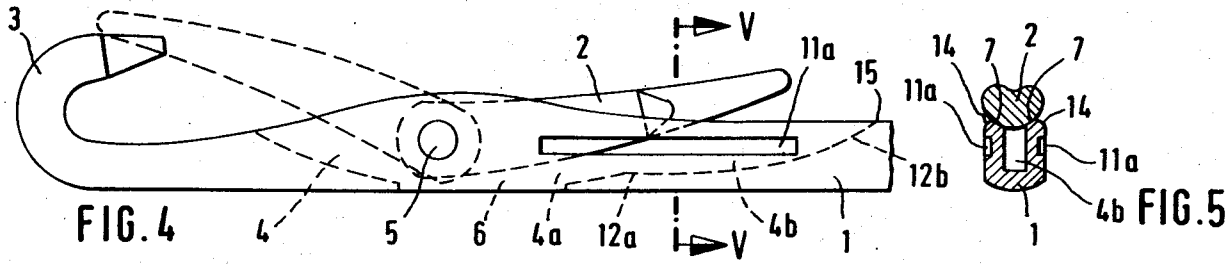
FIG. 4
FIG. 5
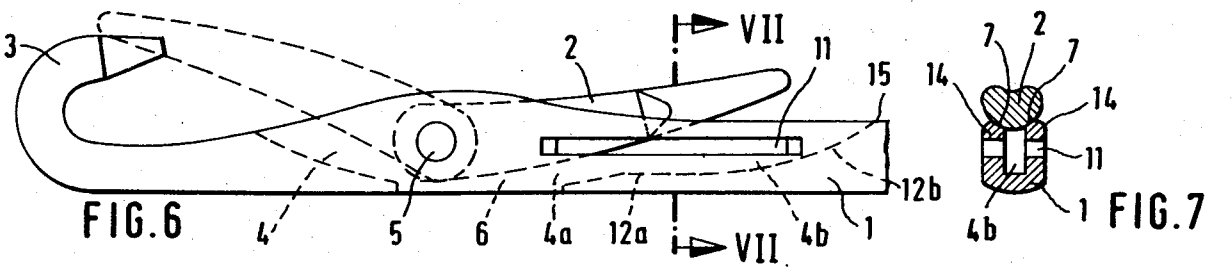
FIG. 6
FIG. 7
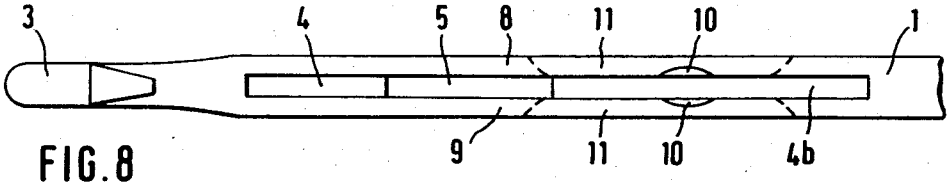
FIG. 8

RESILIENT IMPACT-TYPE LATCH NEEDLE FOR KNITTING MACHINE

This application is a continuation of application Ser. No. 633,594, filed July 23, 1984, abandoned.

The present invention relates to a latch needle for knitting machines, the latch being supported such that it is pivotable in an undamped manner, with the seating surface on the latch spine having wedge-like converging surfaces. Seating surfaces adapted to the seating surface on the latch spine are provided on the upper edges of the side portions of the needle slot, which in turn has an aperture or slit in the region below the latch pivot.

BACKGROUND

In a known latch needle of this type (see U.S. Pat. No. 3,031,867, Wiederhut, assigned to the assignee of this application, to which German Pat. No. 10 69 812 corresponds), the longitudinal needle slot terminates in the region of the seating surfaces on the upper edges of the side faces of the longitudinal needle slot, and the bottom of this slot, in this region, extends such that it becomes flatter toward the upper edge of the needle shank. In a latch needle of this type, the latch strikes these seating surfaces sharply with its spine, which in time, with latch needles subjected to severe stresses, leads to the destruction of the needle latch and shank.

In order to damp the impact of the needle latch in the rear position and thus avoid damage to the needle and latch, an arrangement has already been designed for a latch needle in knitting machines (see U.S. Pat. No. 4,294,086, assigned to the assignee of this application), such that adjoining a first, short portion of the longitudinal needle slot and containing the slit leading to the lower edge of the needle shank a second longitudinal needle slot portion is provided, which with its length extends beyond the end of the opened latch and which is deeper than half the height of the needle shank. The seating surface for the latch spine is located above the second slot portion. As a result of the cooperation between the needle shank side portions flanking the longitudinal slot and the wedge-like convergent flanks of the seating surface on the latch spine, the side portions are spread apart elastically upon the impact of the needle latch, and friction is produced at the same time at the seating surfaces. The result is a considerable damping of the impact of the latch, which is intercepted in a substantially bounce-free manner, thereby protecting both the latch and the needle shank from damage.

This latch needle has proved to be quite superior in use; however, there is a limit to the amount of damping that can be attained for the needle latch striking the seating surface in its rearward position, because, as the thickness of the needle increases, the elasticity of the needle shank side portions flanking the longitudinal slot necessarily decreases.

THE INVENTION

It is an object of the invention to devise a latch needle in which the needle latch, which is essentially supporting in a freely pivotable manner, is intercepted in a damped, substantially bounce-free manner when it strikes the seating faces on the upper edges of the side surfaces of the longitudinal needle slot in its rearward position, so that damage to the needle latch or shank is avoided even in needles having a relatively thick shank.

Briefly, the lateral portions of the shank adjacent to the longitudinal slot and/or in the shank below the seating surfaces are formed with at least one region of increased elastic deformability.

This region of increased elastic deformability may be formed by a lateral slit or slot of predetermined width and depth.

Considerable friction is generated by the wedge-like convergent flanks on the latch spine and the seating surfaces, adapted thereto, on the upper edges of the side portions of the longitudinal needle slot portion, so that richochet or bounce-back of the latch does not occur. At the same time, however, a considerable portion of the kinetic energy of the needle latch in the region of greater elastic deformability located below the seating surfaces is converted into elastic deformation energy. so that the needle latch in the rear position is gently intercepted and damped without resulting in permanent changes in shape or of the even destruction of the latch or shank.

The depth of the side slots embodied in the shank sides can be selected with a view to the elastic deformability to be attained in the vicinity of the seating surfaces for the latch spine. Depending on the particular needle shank thickness, the particular side slot may also be formed in the associated side portion of the shank at a position to penetrate the needle shank and define transverse slits, so that the corresponding seating face is disposed on a thin, flexible rib, defined on one side by the side slit, which is capable of elastic deformation.

It has proved to be suitable for each side slot to be disposed extending substantially parallel to the longitudinal axis of the needle and/or located substantially centrally with respect to the associated seating surface.

Depending on the length of the longitudinal slot in the needle, the side slots or the side slit formed in the shank side portions may be located within the area of the longitudinal needle slot, or they may extend beyond the longitudinal slot and on into the shank. In the latter case, a slit-like opening penetrating all the way through can be defined by the side slots, at least in the vicinity of the shank, thereby increasing the elastic deformability in the region of the shank.

In latch needles in which the longitudinal slot has a second longitudinal slot portion adjoining a first, short longitudinal slot portion containing the slit or aperture through to the lower edge of the needle shank, the second slot portion extending with its length beyond the end of the opened latch and being deeper than half the height of the needle shank—and in which the seating surface for the latch spine is located above the second needle slot portion—a damping of the impact of the latch spine is effected by means of elastically spreading apart the shank side portions defining the longitudinal needle slot. In these latch needles as well, especially for those subjected to great stresses, a further improvement in damping of the impact is attained by regions of increased elastic deformability provided in the shank side portions below the seating surfaces. It has proved advantageous in this respect if the portion of the side slot extending on into the second portion of the longitudinal slot terminates in each shank side portion at a distance behind the associated seating surface.

The drawing illustrates an exemplary embodiment of the subject of the invention.

DRAWING

FIG. 1 shows a latch needle according to the invention, in a fragmentary side view of a first form of embodiment;

FIG. 2 shows the latch needle of FIG. 1, in a section taken on the line II—II of FIG. 1, in a side view;

FIG. 3 is a fragmentary plan view of the latch needle of FIG. 1, without the latch;

FIG. 4 is a fragmentary side view of another form of embodiment of the latch needle according to the invention;

FIG. 5 is a side view of the latch needle of FIG. 4, in a section taken on the line V—V of FIG. 4;

FIG. 6 is a fragmentary side view of a latch needle according to the invention, in a further form of embodiment;

FIG. 7 is a side view of the latch needle of FIG. 6, in a section taken on the line VII—VII of FIG. 6; and FIG. 8 is a fragmentary plan view of the latch needle of FIG. 6, without the latch.

DETAILED DESCRIPTION

The latch needle, shown in various exemplary embodiments in the drawings, has a needle shank 1, a freely pivotable needle latch 2 and a needle hook 3, which merges with the needle shank 1 in the conventional manner. A longitudinal slot 4 is formed in the needle shank 1 and, in the region below the latch pivot 5, is provided with an aperture or slit-like opening 6 toward the lower edge of the needle shank. The back or spine of the latch has wedge-shaped converging flanks (see FIGS. 2, 5 and 7), forming widened, wedge-like rounded portions 7, which already exist, given the conventional rounding of the latch spine.

The longitudinal slot 4 of the needle is defined by two side portions 8, 9, in which seating surfaces 10 for the latch 2, located in its rearward or open position (FIG. 1), are formed on the upper edges of the side faces of the longitudinal slot 4 and are adapted to the seating surface 7 on the latch spine.

In accordance with the invention, and in order to assure an elastically resilient, damped impact of the latch spine on the seating surfaces 10 on the upper edges of the side faces of the shank side portions 8, 9, at least one region of increased elastic deformability is formed respectively in the two shank side portions 8, 9 and/or in the needle shank 1 below the seating surfaces 10 for the latch.

In the form of embodiment shown in FIGS. 1, 2, this region of increased elastic deformation is provided by two side slits 11 disposed in alignment with one another in the two shank side portions 8, 9 and penetrating these shank side portions 8, 9. These slits 11 in the sides are oriented such that they extend substantially parallel to the longitudinal axis of the needle (see FIG. 1). From FIGS. 1 and 3, it is clear that each side slit 11 is disposed substantially centrally with respect to the associated seating surface 10. Furthermore, the two side slits 11 extend beyond the slot 4 of the needle, which is defined by a curved bottom part at 12, and on into the needle shank 1. The side slits 11 thereby define a slit-like opening 13 in the vicinity of the needle shank which penetrates the shank to define, in that region of the shank, an open, transverse slit.

By means of the side slits 11 and the slit-like opening 13, the seating surfaces 10 are disposed on two thin, flexible ribs 14 fastened at both ends and defined on one side by the side slits 11; these ribs 14 are resilient in an elastically damped manner in response to the effect of the impact of the needle latch 2. The thickness of the ribs 14 may be selected to correspond to the amount of elastic deformation to be attained.

While in the exemplary embodiment shown in FIGS. 1–3 the longitudinal slot 4 of the needle is dimensioned such that its curved bottom portion 12 adjoining the slit 6 terminates at a location 15 (FIG. 3) of the upper edge of the needle shank located before the end of the opened needle latch 2, the arrangement in the forms of embodiment shown in FIGS. 4–8 is such that the longitudinal slot 4 has a short first slot portion **4*a*, containing the slit 6 leading to the lower edge of the needle shank, which is adjoined by a second, or further slot portion 4*b*, which with its length at 15 extends beyond the end of the opened needle latch 2 and has a substantially flat, or slightly curved, bottom portion 12*a* which is adjoined by a curved bottom portion 12*b*, which extends in the upper edge of the needle shank, merges therewith and ends there. The substantially flat bottom portion 12*a* of the second portion 4*b* of the longitudinal slot of the needle is located deeper than half the height of the needle shank; the seating surfaces 10 for the latch spine are disposed above the second needle slot 4*b*, specifically above the substantially rectilinear bottom portion 12*a* (see FIG. 8). Thus, the further, or second portion will be located between the seating surfaces, forming supporting portions of the needle shank for the widened, rounded portion 7 of the spine of the latch 2**.

In the form of embodiment shown in FIGS. 4, 5, the regions of greater elastic deformability are formed by side slots **11*a* of predetermined depth, which are disposed in alignment with one another in the shank side portions 8, 9. The side slots 11*a* are cut-in, that is, machined or milled, from outside into the shank side portions 8, 9 and do not extend as far in as the longitudinal slot 4. They are also aligned parallel to the longitudinal axis of the needle and disposed approximately centrally with respect to the particular seating surface 10 associated with them, which means that each side slot 11*a* extends beyond the region of the aperture and into the second portion 4*b* of the longitudinal needle slot 4 and terminates at some distance behind the seating surface 10. The seating surface 10 is recessed with respect to the upper edge of the shank 1**.

The flexible ribs 14 defined by the side slots **11*a* are less elastic in this case than in the form of embodiment shown in FIGS. 1–3, in which the side slots 11 are embodied as penetrating the shank. By the appropriate dimensioning of the depth and width of the side slots 11*a*, the amount of elastic deformation of the ribs 14 bearing the seating surfaces 10** can be adjusted appropriately to given requirements.

In principle, the embodiment of the side slots 11 in the embodiment shown in FIGS. 1–3 may correspond to that of the form of embodiment of FIGS. 4, 5, at least in the vicinity of the longitudinal slot 4 of the needle. in that case, the longitudinal slot 4 would be closed toward the side.

The form of embodiment shown in FIGS. 6–8 differs from that of FIGS. 4 and 5 only in that the side recesses do not, as at **11*a*, extend merely to a predetermined depth but instead are formed as slits penetrating all the way through, as in the form of embodiment according to FIGS. 1–3. They are therefore identified by reference numeral 11 in FIGS. 6–8**.

Otherwise, elements identical to those of the form of embodiment of FIGS. 4, 5 are identified by the same reference numerals and need not be described again.

For all the forms of embodiment described above, it is characteristic that instead of one side slit or slot 11, 11*a* on each side of the needle shank 1, a plurality of side slits or of slots located one above another may also be used, or side slots having a cross section different from the U shape may be used, for instance having a wedge-shaped or rounded cross section. In individual cases it is also possible for the regions of greater elastic deformability to be formed by holes (blind holes, as appropriate) or corresponding recesses in the shank side portions 8, 9 and/or in the needle shank 1.

The latch pivot 5 may be formed either by a through-shaft or, for example. by inwardly projecting small bumps or tips which fit into a shaft opening formed in the latch. Thus, it is important to maintain the spacing of the side portions of the shank such that, for example, oppositely facing inwardly extending projections to define the pivot point 5 for the latch will not spread apart and permit the latch to fall out. Accordingly, the slit 6 can have only a limited extent, to prevent spreading of the side portions of the latch needle. If a double-portion slot or, rather, a combination through slit 6, slot portion 12*a* and slits 11 arrangement is used (see, for example, FIG. 6), the lower, uninterrupted portion 12*a*, defining merely the lower edge of the slot 4*b*, provides the necessary strength for the side portions to hold the latch 2 securely on the needle shank, while permitting free pivoting movement thereof.

I claim:

1. Latch needle for a knitting machine having a needle shank (1) having shank side portions (8, 9);

a latch (2) pivotably secured to the needle shank, the latch having converging surfaces (7) on the side engaging the shank when the latch is in open, or rear position;

a longitudinal slot (4) formed in the needle shank, the slot separating the shank side portions;

latch engagement surfaces (10) formed on the side portions (8, 9) of the shank to seat the latch when the latch is in open position;

and wherein, in accordance with the invention, the shank side portions (8, 9) located beneath the engagement surfaces (10) of the shank for the latch (2) are formed with a region (11, 11*a*) of greater elastic deformability than remaining regions of the shank, wherein the region of greater elastic deformability in each shank side portion is formed by a transverse slit (11) extending through the associated shank side portion (8, 9).

2. Latch needle according to claim 1, wherein the transverse slit extends through the shank (1) in a plane transversely to the longitudinal slot (4).

3. Latch needle according to claim 1, wherein the needle shank has an upper edge and a lower edge, and a hook on at least one end thereof;

the latch (2) has a spine with a widened, wedge-like rounded portion (7), forming said converging surfaces, and a portion engaging the engagement surfaces (10), the engagement surfaces forming a latch supporting portion (10) and being recessed relative to the upper edge of said needle shank;

said longitudinal slot (4) having a short recessed portion (4*a*) containing an aperture (6) leading to the lower edge of the needle shank and a further portion (4*b*) adjacent to said short portion deeper than half the height of said needle shank and projecting in length beyond the engagement surfaces for said latch, said further portion being located beneath said supporting portion of said needle shank for said widened rounded portion (7) of the spine of the latch (2) and terminating in a curved wall portion (12*b* ) which merges with said upper edge of the needle shank, and wherein the slits (11) extend into the region of the further portion (4*b*) of the longitudinal slot (4) of the needle and terminate at a distance behind the engagement surfaces (10) for the latch (2).

4. Latch needle according to claim 3, wherein the side slits (11) in the side portions (8, 9) are located substantially centrally with respect to the engagement surfaces (10) for the latch.

5. Latch needle according to claim 1, wherein the side slits (11) in the side portions extend substantially parallel to the longitudinal axis of the needle.

6. Latch needle according to claim 1, wherein the side slits (11) in the side portions (8, 9) are located substantially centrally with respect to the seating surfaces (10) for the latch.

7. Latch needle according to claim 1, wherein the slits (11) in the side portions (8, 9) extend beyond the longitudinal slot (4) of the needle and on into the shank (1).

8. Latch needle for a knitting machine having a needle shank (1) having shank side portions (8, 9);

a latch (2) pivotably secured on the needle shank, the latch having converging surfaces (7) on the side engaging the shank when the latch is in open or rear position;

a longitudinal slot (4) formed in the needle shank;

latch engagement surfaces (10) formed on the side portions (8, 9) of the shank to seat the latch when the latch is in open position;

and wherein, in accordance with the invention, the shank side portions (8, 9) located beneath the engagement surfaces (10) of the shank for the latch (2) are formed with a region (11*a*) of greater elastic deformability than remaining regions of the shank, wherein the region of greater elastic deformability in each shank side portion (8, 9) is formed by a respective side slot (11*a*) of predetermined depth.

9. Latch needle according to claim 8, wherein each side slot (11*a*) extends substantially parallel to the longitudinal axis of the needle.

10. Latch needle according to claim 8, wherein each side slot (11*a*) is located substantially centrally with respect to the associated engagement surfaces (10) for the latch (2).

11. Latch needle according to claim 8, wherein the needle shank is formed with an aperture (6) extending from the longitudinal slot (4) to a lower edge of the needle shank; and the side slots (11*a* ) extend beyond the longitudinal extent of the aperture and on into the shank (1).

12. Latch needle according to claim 8, wherein the needle shank has an upper edge and a lower edge, and a hook (3) on at least one end thereof; the latch (2) has a spine with a widened wedge-like, rounded portion (7), forming said converging surfaces, and a portion engaging the engagement surfaces (10), the engagement surfaces forming a latch supporting portion (10) and being recessed relative to the upper edge of said needle shank;

said longitudinal slot (4) having a short recessed portion (4*a*) containing an aperture (6) leading to the lower edge of said needle shank and a further portion (4*b*) adjacent to said short portion deeper than half the height of said needle shank and projecting in length beyond the engagement surfaces for said latch, said further portion (4*b*) being located beneath said supporting portion (10) of said needle shank for said widened, rounded portion (7) of the spine of the latch (2) and terminating in a curved wall portion (12*b*) which merges with said upper edge of the needle shank, and wherein the side slot (11*a*) extends into the region of the further portion (4*b*) of the longitudinal slot (4) of the needle and terminates at a distance behind the engagement surfaces (10) for the latch (2).

* * * * *